US007975597B2

(12) United States Patent
Darbois et al.

(10) Patent No.: US 7,975,597 B2
(45) Date of Patent: Jul. 12, 2011

(54) HYDRAULIC MACHINE, IN PARTICULAR HYDRAULIC MOTOR, WITH A RECIPROCATING MOVEMENT

(75) Inventors: Matthieu Darbois, Bordeaux (FR); Sébastien Furet, Bruges (FR); Philippe Duquennoy, Camarsac (FR); Dominique Berton, Le Bouscat (FR)

(73) Assignee: Dosatron International, Tresses (FR)

( * ) Notice: Subject to any disclaimer, the term of this patent is extended or adjusted under 35 U.S.C. 154(b) by 610 days.

(21) Appl. No.: 12/160,311

(22) PCT Filed: Dec. 7, 2006

(86) PCT No.: PCT/FR2006/002673

§ 371 (c)(1),
(2), (4) Date: Jul. 9, 2008

(87) PCT Pub. No.: WO2007/080249

PCT Pub. Date: Jul. 19, 2007

(65) Prior Publication Data

US 2010/0282072 A1 Nov. 11, 2010

(30) Foreign Application Priority Data

Jan. 13, 2006 (FR) ..... 06 00315

(51) Int. Cl.
*F01L 31/02* (2006.01)
*F01L 15/12* (2006.01)

(52) U.S. Cl. ..... 91/346; 91/224

(58) Field of Classification Search ..... 91/224, 91/344, 346

See application file for complete search history.

(56) References Cited

U.S. PATENT DOCUMENTS

| | | | | |
|---|---|---|---|---|
| 4,558,715 | A * | 12/1985 | Walton et al. | 91/347 |
| 4,785,713 | A | 11/1988 | Cloup | |
| 5,058,768 | A * | 10/1991 | Lichfield | 91/346 |
| 5,137,435 | A * | 8/1992 | Walton | 91/347 |
| 5,167,292 | A | 12/1992 | Moiroux et al. | |
| 5,505,224 | A * | 4/1996 | Urrutia et al. | 91/229 |
| 6,579,028 | B1 | 6/2003 | Urrutia | |
| 6,684,753 | B1 | 2/2004 | Urrutia | |
| 6,910,405 | B2 * | 6/2005 | Walton et al. | 91/322 |

FOREIGN PATENT DOCUMENTS

| | | |
|---|---|---|
| EP | 0 217 699 A1 | 4/1987 |
| EP | 1 151 196 | 8/2000 |
| FR | 2 619 165 A | 2/1989 |
| FR | 2 629 171 A | 9/1989 |
| WO | 00/47907 A | 8/2000 |

* cited by examiner

*Primary Examiner* — Michael Leslie
(74) *Attorney, Agent, or Firm* — Young & Thompson

(57) ABSTRACT

Hydraulic machine includes: a casing; a piston slidable therein and separating two chambers; hydraulic switching elements for supplying liquid to and for evacuating the chambers, including at least one connecting rod acting on a distribution member which can adopt two stable positions; and initiating elements having a pusher which, at the end of the piston stroke, can cause a sudden change in the position of the switching elements, under the action of an elastic member to reverse the stroke. Each end of the elastic member is secured to an articulation member respectively accommodated in a housing provided on the connecting rod and on another moving part, each housing being open in a direction substantially opposed to the direction of the force exerted by the elastic member, such that each articulation member can be removed from its open housing against the action of the force, thereby simplifying assembly and disassembly.

20 Claims, 5 Drawing Sheets

HYDRAULIC MACHINE, IN PARTICULAR HYDRAULIC MOTOR, WITH A RECIPROCATING MOVEMENT

The invention relates to a hydraulic machine, in particular a hydraulic motor, which machine is of the kind comprising:

a casing;

a piston capable of sliding with a reciprocating movement in the casing, the piston separating two chambers of the casing;

hydraulic switching means for supplying liquid to and for evacuating the chambers separated by the piston, these switching means being controlled by the movements of the piston and comprising at least one connecting rod acting on a distribution member which can adopt two stable positions; and triggering means comprising a pusher capable, at the end of the stroke of the piston, of causing a sudden change in the position of the switching means, under the action of an elastic means, in order to reverse the stroke.

A hydraulic motor of this kind is known, for example, from EP-B-0 255 791, or from U.S. Pat. No. 5,505,224 or from EP-B-1 151 196. This hydraulic motor can be used to drive a device for injecting an additive into a main liquid, said liquid serving to operate the motor.

The number of parts used in hydraulic motors of this kind that are known to date is relatively high, in particular for producing the triggering means with their elastic means. This results in relatively complicated assembly and disassembly operations, thus not facilitating either manufacture or maintenance, for example for the replacement of worn parts. It is desirable, furthermore, for the triggering means to be formed by a simple mechanism.

Therefore, the object of the invention is, especially, to provide a hydraulic machine of the kind defined above, in particular a hydraulic motor, which can be assembled and disassembled more simply and more quickly. It is also desirable to make manufacture easier with a reduced number of parts.

Furthermore, the solution proposed should make it possible to dispense with any metal parts, particularly metal springs, so as to increase the resistance of the machine to chemical products that are to be metered. It would be advantageous for the product that is to be metered, especially chemical product, to be injected into the outlet chamber of the machine alone.

It is also desirable to improve the conditions in which sealing between the various sections of the piston and the wall of the casing is provided.

According to the invention, a hydraulic machine with a reciprocating movement, in particular a hydraulic motor, of the kind defined above is characterized in that the elastic means is secured, at each of its ends, to an articulation member respectively accommodated in a housing provided on the connecting rod and on another moving part of the machine, each housing being open in a direction substantially opposite to the direction of the force exerted by the elastic means in the housing, such that each articulation member of the elastic means can be removed from its open housing against the action of said force, thereby simplifying assembly and disassembly.

The articulation member secured to the elastic means at each of its ends is advantageously constituted by a cylindrical spindle, transverse to the direction of the force exerted by the elastic means, forming an articulation axis.

The elastic means may be constituted by a spring leaf in the form of a curved arc, in particular substantially in the form of a semicircle. This spring leaf is advantageously made of plastic and the articulation spindles provided at each end are molded in one piece with this spring leaf.

In the case of a differential hydraulic machine with a piston having a region of large cross section and a region of smaller cross section, the switching means may comprise a valve holder with at least a first valve whose seat is provided on the small section of the piston, and at least a second valve whose seat is provided on the large section of the piston, each valve comprising a stem coupled to the valve holder, one of the valves being situated on the same side as the connecting rod, with respect to the piston, and the other valve being situated on the opposite side with a stem which passes through the seat to bring about coupling with the valve holder; the stem of the valve situated on the opposite side to the connecting rod is preferably coupled by being snap-fastened to the valve holder, this snap-fastening being accessible from that side of the piston where the connecting rod is situated, such that disassembly of the valve and removal of the valve holder are thereby facilitated.

The connecting rod is articulated at its end remote from the elastic means at a point which is fixed relative to the piston. Advantageously, the connecting rod is secured, at its end remote from the elastic means, to an articulation pin oriented transversely to the connecting rod and accommodated in a notch provided in a wall secured to the piston and parallel to the axis of the piston, this notch being open in the direction opposite to the direction of the force exerted by the elastic means on the connecting rod. The pin of the connecting rod is simply engaged in this notch, thus allowing particularly simple and quick disassembly.

Preferably, two parallel component connecting rods are provided, interconnected by a crosspiece, each component connecting rod comprising, at its end close to the elastic means, a housing which is open facing the other connecting rod so as to accommodate one end of the articulation pin secured to the elastic means.

Each connecting rod may comprise two parallel branches between which is provided the pin for articulation on the piston, this pin being molded in one piece with the two branches of the connecting rod.

The pusher is secured in its upper part to a gantry having two walls, which surround the elastic means, and at least one notch which opens on the opposite side to the connecting rod, each notch accommodating one of the ends of the articulation pin of the elastic means. The two walls flanking the elastic means are extended on the opposite side to the rod and are joined together by a crosspiece in the upper part, this crosspiece constituting the upper limit stop of the pusher.

The two walls of the gantry may comprise, on either side of the regions provided with the notches accommodating the articulation pin of the elastic means, outer projections capable of cooperating with walls secured to the piston for guiding the pusher relative to the piston.

The valve holder may have the form of a frame, vertical in the operating position, comprising on its two vertical sides outwardly projecting ribs capable of cooperating with corresponding guide grooves provided in the piston. The lower horizontal side of the frame comprises open housings allowing a readily disassemblable coupling of at least one and preferably two valves having their seat on the small section of the piston and situated on the same side as the connecting rod. The upper horizontal side of the frame is extended, at each end, beyond vertical pillars and comprises open housings for accommodating by simple snap-fastening the stem of a valve, having its seat on the large section of the piston, on the opposite side to the connecting rod.

The valve holder may comprise, on its upper horizontal side, an upwardly projecting yoke which, by way of its lateral legs, flanks the elastic means formed by a leaf in the shape of a curved arc. This yoke is intended to provide a bypass operation of the machine when it comes to bear against the cover of the casing.

The piston is provided at its large section and its small section with sealing lips oriented in opposite directions and facing one another. Preferably, these sealing lips are provided on disassemblable circular rings, and the piston is molded in one piece.

Each sealing ring is advantageously fastened to the piston by a bayonet-type assembly comprising radial projections on the internal surface of the seal and corresponding peripheral grooves on the external surface of the piston, with grooves parallel to the geometric axis of the piston to allow each projection of the seal to come level with a corresponding peripheral groove of the piston.

The ring provided at the large section of the piston advantageously has a V-shaped profile whose concavity faces toward the small section, and comprises on the opposite side a frustoconical sealing lip whose diameter increases in the direction of the cover of the casing.

The circular ring of the small section of the piston has a V-shaped cross section whose concavity faces toward the large section.

Apart from the provisions set forth above, the invention involves a certain number of other provisions which will be dealt with more explicitly below with reference to an exemplary embodiment which is described with reference to the appended drawings but which is in no way limiting. In these drawings.

Figure 1:
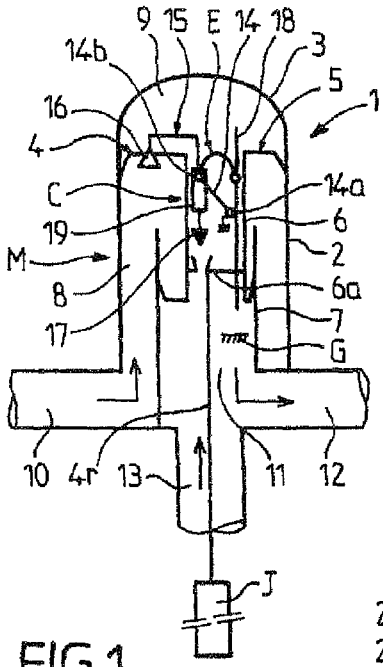
FIG. 1 is a simplified schematic representation in vertical section of a hydraulic motor according to the invention.
Figure 2:
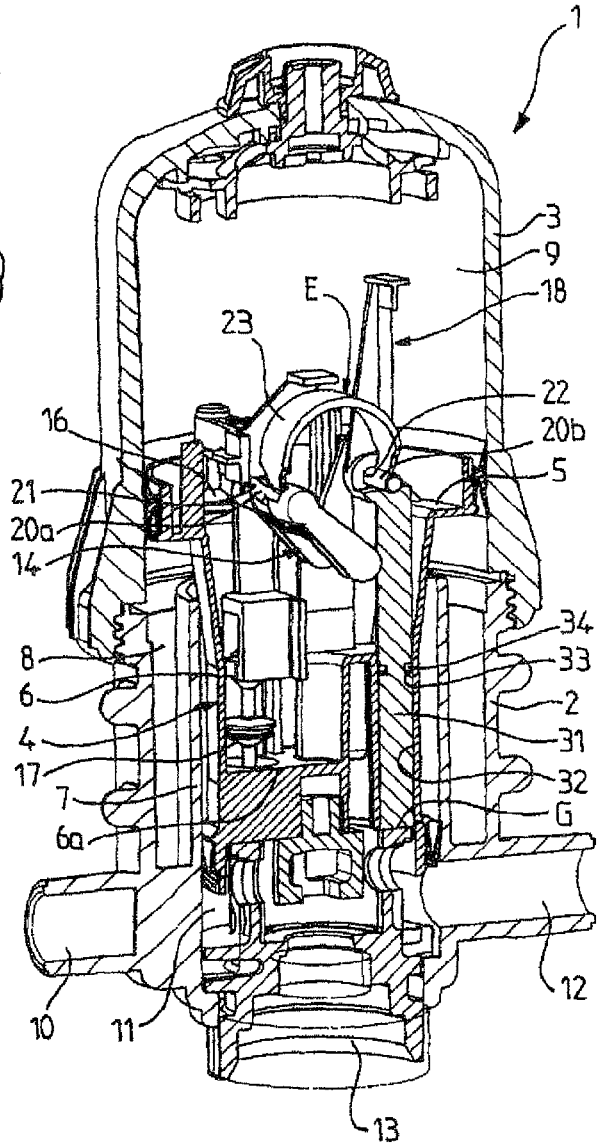
FIG. 2 is a perspective view, in vertical section, of a hydraulic motor according to the invention.

Referring to the drawings, in particular to FIGS. 1 and 2, there can be seen a hydraulic machine constituted by a differential hydraulic motor with a reciprocating movement. The description which follows essentially concerns a differential motor, that is to say a motor whose piston has two regions of different cross section, but the invention can equally well be applied to motors with a simple piston or with a diaphragm in place of the piston.

The motor M comprises a casing 1 consisting of a cylindrical body 2 capped by a cover 3 which is fitted onto the body 2 in a disassemblable manner, in particular by screwing.

A differential piston 4 is arranged in the casing 1 so that it can slide with a reciprocating movement. In its upper part, the piston 4 comprises a region 5 of large cross section, in the form of a crown, the periphery of which bears in a sealed manner against the internal wall of the casing 1. A substantially cylindrical shank 6, which is coaxial with the casing 1 and of smaller diameter than the crown 5, is secured to this crown and extends downwardly. The lower part of the shank 6 slides in a sealed manner in a cylindrical housing 7 which is coaxial with the casing 1. The shank 6 is closed in its lower part by a bottom 6*a*, constituting the region of small cross section of the piston.

The piston 4 separates the inner volume of the casing 1 into two chambers, one chamber 8 situated below the crown 5, and one chamber 9 situated above the crown 5. The chamber 8 is an annular chamber contained between the casing 1, the outer surface of the housing 7 and the outer surface of the shank 6. An inlet pipe 10 leads into the lower part of the chamber 8. The inner volume of the housing 7 situated below the bottom 6*a* of the piston constitutes a third chamber 11, or outlet chamber, to which is connected an outlet pipe 12 whose axis is orthogonal to the axis of the casing.

A cylindrical sleeve 13 which is coaxial with the casing 1 extends downwardly to allow the connection to a device J for injecting a liquid additive into the outlet chamber 11. This injection device is actuated by the motor, the piston 4 of which is connected by a rod 4*r* to a means for pumping the additive. For more details on this type of motor, reference may be made to EP 0255791, EP 1 151 196 and WO 2004/051085.

Hydraulic switching means C are provided for supplying liquid to and for evacuating the chambers 8, 9 separated by the piston. These switching means C are controlled by the movements of the piston 4 and comprise a connecting rod 14 acting on a distribution member 15 which can adopt two stable positions. In one of the stable positions, the chamber 8 receives the liquid under pressure while the chamber 9 is connected to the outlet 12. In the other position of the distribution member 15, the chamber 9 receives the liquid under pressure and is isolated from the chamber 11.

In the example represented in the drawings, the distribution member 15 is constituted by a valve holder comprising at least a first valve 16 whose seat is situated below the crown 5, the valve 16 having a head situated in the chamber 8. The valve 16 closes by moving from bottom up according to the drawings. The distribution member 15 is provided with at least one other valve 17 whose head is situated in the chamber 9. The seat of each valve 17 is situated on the bottom 6*a*. The valve 17 closes by a descending movement against its seat.

The motor additionally comprises triggering means which comprise a pusher 18 capable, at the end of the stroke of the piston and by bearing against a limit stop, of causing a sudden change in the position of the switching means C under the action of an elastic means E, in order to reverse the stroke of the piston.

The connecting rod 14 is articulated at one end 14*a* to a point which is fixed with respect to the piston 4. The other end 14*b* of the connecting rod can move within a vertical window 19 of the valve holder and butt against one of the two ends of this window, in one of the two stable positions of the distribution member 15.

Figure 6:
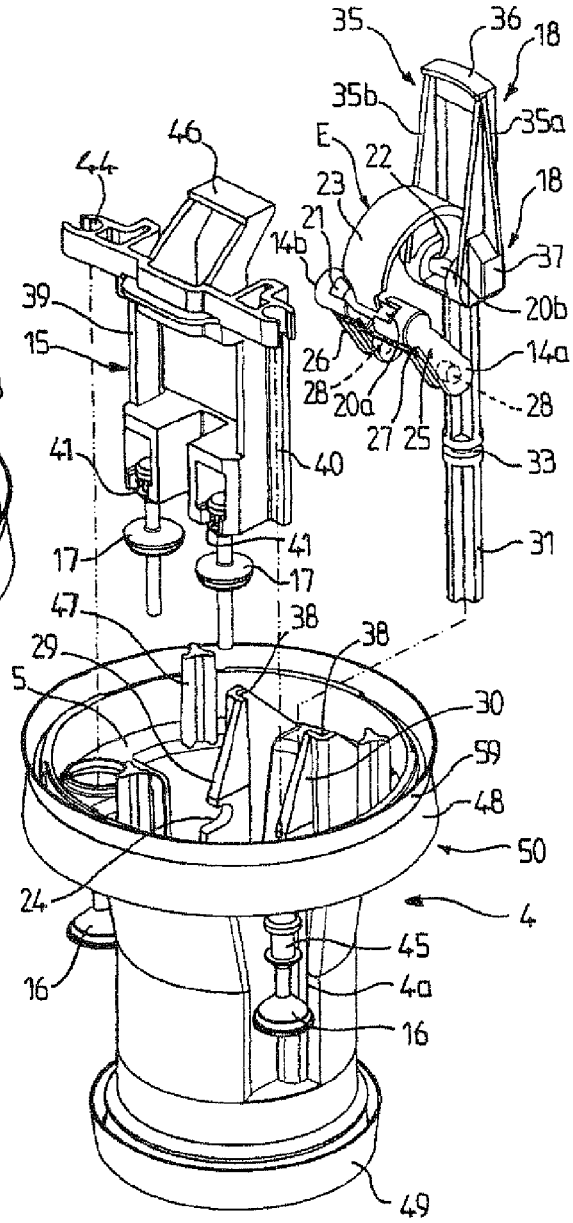
FIG. 6 is an exploded perspective view of the piston in FIG. 5 and of the various disassembled parts.

According to the invention, and as can be seen from FIGS. 2 and 6, the elastic means E is secured, at each of its ends, to an articulation member 20*a*, 20*b* respectively accommodated in a housing 21 provided on the connecting rod and 22 on another moving part of the machine, namely the pusher 18 in the example represented. Each housing 21, 22 is open in a direction substantially opposite to the direction of the force exerted by the elastic means E in the wall of the housing in question. The articulation member 20*a*, 20*b* is disassembled from its housing with a simple translational movement by exerting a force counter to that of the elastic means E. The articulation members 20*a*, 20*b* are retained in their housing by the force developed by the elastic means E.

This elastic means E is advantageously constituted by a spring leaf 23 substantially in the form of a convex curved arc, particularly a substantially semicircular arc. The leaf 23 is secured at each end to a cylindrical spindle orthogonal to the plane of the curved arc, this spindle constituting the articulation member 20*a*, 20*b*.

Preferably, the spring leaf 23 is made of plastic, and is molded in one piece with the cylindrical spindles 20*a*, 20*b*. The spring leaf 23 has its convexity directed to the opposite side to the bottom 6*a* of the piston.

The connecting rod 14 is articulated, at its end 14*a* remote from the housing 21 accommodating the spindle 20*a*, in a notch 24 (FIG. 6) which is fixed with respect to the piston 4.

The connecting rod 14 (FIGS. 2 and 6) is advantageously formed by two parallel component connecting rods 25, 26 interconnected by a crosspiece 27 which is closer to the end 14*b* than to the other end 14*a*. The ends of the connecting rods 25 and 26 forming the end 14*b* have a cylindrical shape whose geometric axis is orthogonal to the longitudinal direction of the connecting rods. Each of these cylindrical ends comprises a housing 21 which faces toward the other component connecting rod and is open on the opposite side to the end 14*a*. Each housing 21 accommodates one end of the spindle 20*a* which projects transversely on either side of the leaf 23. Preferably, the spindle 20*a* can be snap-fastened into the housing 21.

Each component connecting rod 25, 26 comprises two parallel branches between which is provided, at the end 14*a*, an articulation pin 28 accommodated in the notch of the piston. A pin 28 is provided for each component connecting rod 25, 26. Each pin 28 is molded in one piece with the two branches of the component connecting rod. The two component connecting rods 25, 26 are molded in one piece with the crosspiece 27 such that the connecting rod 14 is constituted by a single plastic part.

The notches 24 for articulation on the piston form a substantially semicircular housing for a free engagement of a pin 28. The notches 24 are provided in walls 29, 30 which are parallel to one another and to the geometric axis of the piston, equidistant from these walls. The spacing between the walls 29, 30 is equal to the spacing between the articulation pins 28 of the two component connecting rods, while the thickness of the walls 29, 30 is smaller than the distance between the internal faces of the two parallel branches of one and the same component connecting rod. Each wall 29, 30 is flanked by two parallel branches of one and the same component connecting rod.

Each notch 24 is open in the opposite direction to the force exerted by the elastic leaf 23 on the connecting rod 14, which force pushes and maintains each pin 28 in bearing contact against the bottom of the notch 24. The pin 28 is simply engaged in the notch 24, preferably without snap-fastening. The operations of assembling and disassembling the connecting rod 14, with its two pins 28 respectively in the notches 24, are particularly simple and quick.

The pusher 18, as can be seen from FIG. 6, comprises a rod 31, for example with a cruciform cross section, slidably guided in a well 32 (FIG. 2) of the piston. The rod 31 comprises, substantially half way along its length, a groove 33 for accommodating an O-ring seal 34 which ensures a sealed sliding movement in the well 32. The upper end of the rod 18 is secured to a frame 35 comprising a transverse base secured to the upper end of the rod 18. The frame 35 also comprises two longitudinal walls 35*a*, 35*b*, parallel to the geometric axis of the rod 18, flanking the elastic leaf 23 and connected at the top by a crosspiece 36. Each wall 35*a*, 35*b* comprises at its base secured to the rod 18 a substantially semicircular notch 22 which opens on the opposite side to the connecting rod 14. Each notch 22 accommodates one of the ends of the articulation spindle 20*b*, preferably with snap-fastening. The frame 35 forms a sort of gantry and the crosspiece 36 in the upper part constitutes the upper limit stop of the pusher.

The ends of the leaf 23 preferably have a reduced width which determines the admissible minimum spacing between the mutually opposite faces of the inner end walls of the housings 21 or 22.

The pusher 18 with its frame 35 is also produced in one piece from plastic. The operation of assembling the spindle 20*b* in the housings 22 or of disassembling it therefrom is particularly simple and quick, by elastic deformation of the leaf 23.

Figure 5:
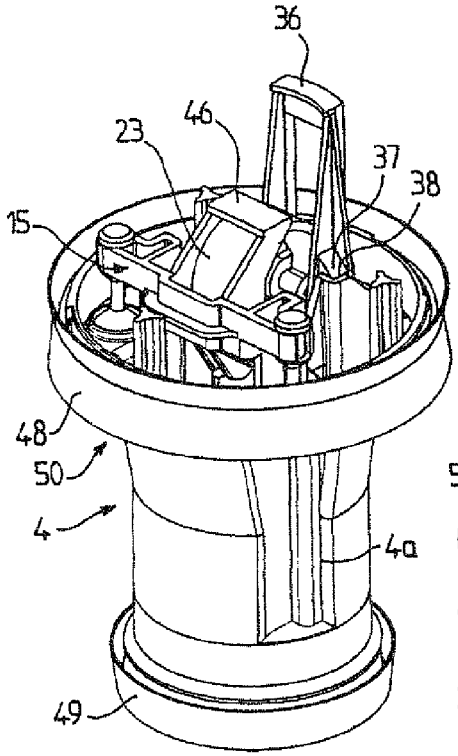
FIG. 5 is a perspective view of the differential piston with valves, valve holder, elastic means and pusher in place.

The two longitudinal walls 35*a*, 35*b* of the gantry 35 outwardly comprise, on either side of the regions provided with the notches 22, projections 37, for example in the form of truncated pyramids, bounded by a planar apex face parallel to the geometric axis of the rod 31 and orthogonal to the spindle 20*b*. The projections 37 are capable of cooperating with walls 38 (FIGS. 5 and 6) which are in the form of a right dihedral which are secured to the piston and serve to guide the gantry 35. The walls 38 join to the walls 30 along an edge parallel to the axis of the piston, on the opposite side to the notches 24.

Figure 4:
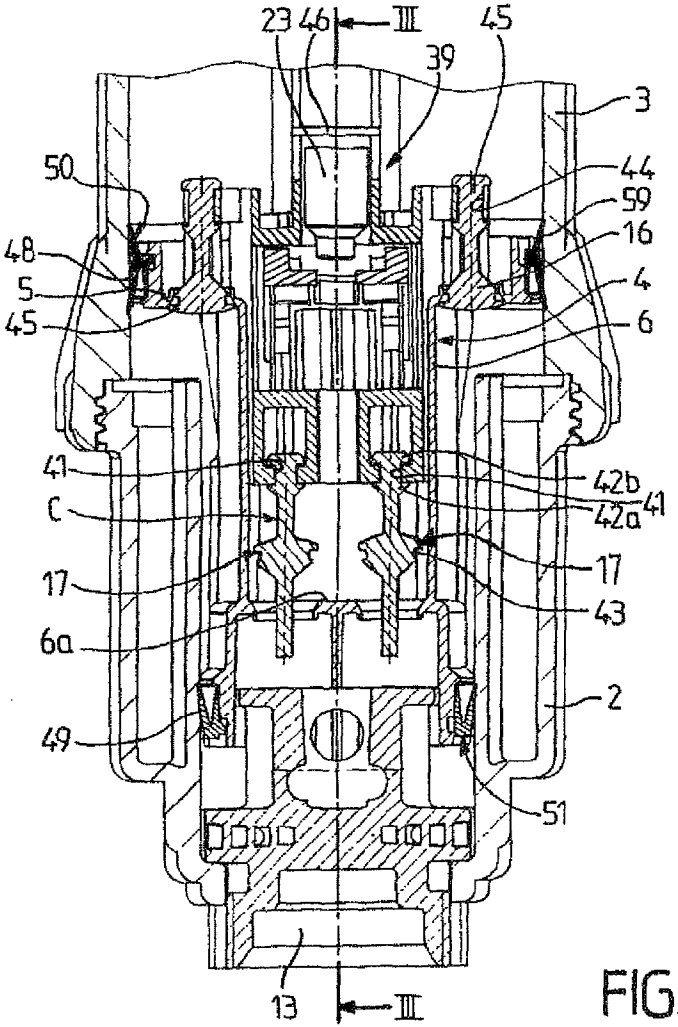
FIG. 4 is a partial vertical section on line IV-IV in FIG. 3.
Figure 3:
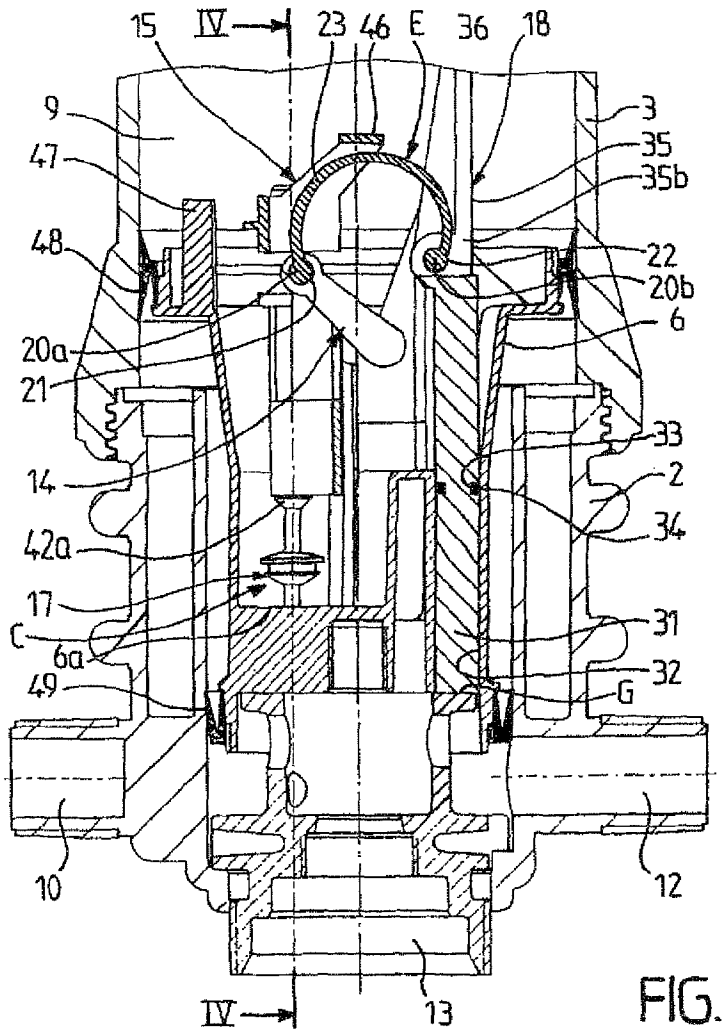
FIG. 3 is a partial vertical section of the hydraulic motor on line III-III in FIG. 4.

The valves 16, 17 are mounted on the valve holder 15 (FIG. 6) substantially having the form of a frame 39, vertical in the operating position of the motor, comprising on its two vertical sides outwardly projecting ribs 40 capable of cooperating with guide grooves (not shown) provided in the piston 4. The lower horizontal side of the frame 39 comprises two open housings 41 allowing a coupling, with snap-fastening of the cylindrical stem of a valve 17, by a translational movement perpendicular to the plane of the frame 39. The lower edges of each housing 41 are housed, with a certain clearance in a direction parallel to the axis of the piston, between two collars or disks 42*a*, 42*b* (FIG. 4) secured to the stem of the valve. The actual valve is constituted by a disk comprising a groove 43 (FIG. 4) at its periphery for accommodating a seal.

The respective seats of the valves 17 are provided on the bottom 6*a* of the small section of the piston 4. The valves 17 are situated on the same side as the connecting rod 14 with respect to the piston 4.

The upper horizontal side of the frame 39 (FIG. 6) is extended beyond vertical pillars of the frame and comprises, at each end, a laterally open housing 44, with a larger cross section than a semicircle, for accommodating with snap-fastening a cylindrical stem 45 (FIG. 4) secured to the valve 16. The stem 45 comprises two radially projecting collars between which is housed the wall of the housing 44. Two valves 16 are provided, to which correspond two seats 45 on the large section 5 of the piston, symmetrically with respect to a plane passing through the axis of the piston and orthogonal to the pivoting axis of the connecting rod 14.

The valves 16 are oriented with their stem 45 directed upwardly which is engaged through the opening of the seat to be attached to the housing 44, on the same side of the large section 5 as the connecting rod 14. When the cover 3 is disassembled, it is possible to gain access to the stems 45 of the valves 16 in order to engage them in the housings 44 or disengage them therefrom.

The valve holder 15, 39 advantageously comprises, on its upper horizontal side, an upwardly projecting yoke 46 which flanks the elastic leaf 23 (FIG. 5) by way of its lateral legs.

This yoke 46 is intended, when it comes to bear against the cover 3 of the casing, for example following a failure of a part of the motor, to provide a bypass operation of the machine, the valves being kept open.

The valve holder 15, 39 forms a single piece which can be made of molded plastic.

Posts 47, three for example, with a three-point star-shaped cross section, secured to the large section 5 of the piston, project upwardly parallel to the axis of the piston and are distributed at 120° from one another in the vicinity of the periphery of the piston. The posts 47 constitute mechanical safety stops against the cover 3 of the casing in the event of a part breaking or of an excess flow, the height of these posts 47 being designed accordingly.

The piston 4 is provided, at its large section and its small section, with sealing lips 48, 49 (FIGS. 6 and 7) facing one another.

Figure 7:
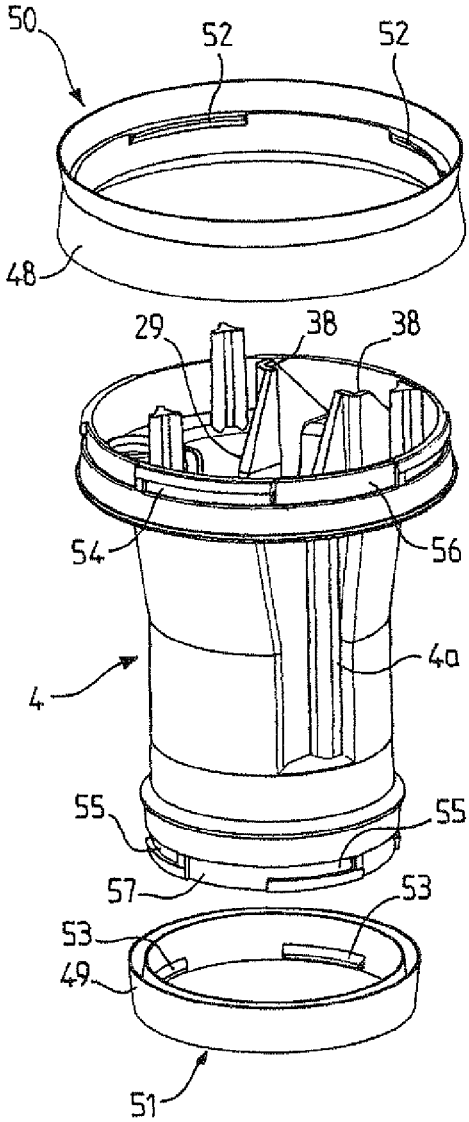
FIG. 7 is an exploded perspective view of the piston on its own and of the disassembled seals.

The sealing lips 48, 49 are provided on disassemblable circular sealing rings 50, 51, which can be seen clearly in FIG. 7. The piston 4 can thus be molded in one piece, advantageously from plastic.

Each sealing ring 50, 51 is advantageously fastened to the piston 4 by a bayonet-type assembly comprising radial projections 52, 53 on the internal surface of the respective rings 50, 51. The projections 52, 53 are capable of cooperating with corresponding peripheral grooves 54, 55 provided on the external surface of the large section and the small section of the piston. Reliefs 56, 57 having generatrices parallel to the axis of the piston are provided on the outer periphery of the large and small sections to enable the radial projections 52, 53 to be brought opposite the entry to the peripheral grooves 54, 55 by a translational movement parallel to the axis of the piston. Then, by means of a rotational movement about this axis of the piston, the ribs 52, 53 are engaged in the grooves 54, 55 with locking of the corresponding sealing ring 50, 51. The rings 50, 51 are quickly disassembled by a reverse movement.

Figure 9:
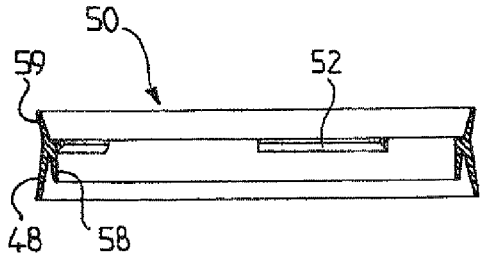
FIG. 9 is a section on line IX-IX in FIG. 8.
Figure 10:
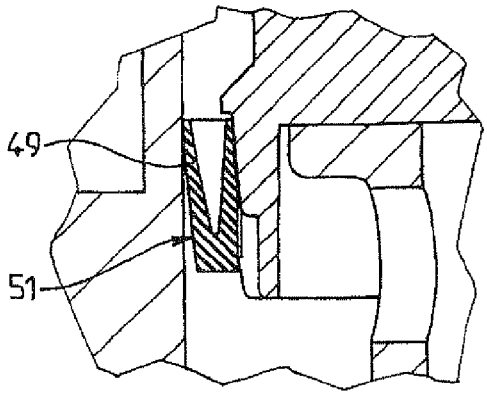
FIG. 10 is a vertical section of the seal for the small section of the piston.

As can be seen from FIG. 9, the sealing ring 50 provided at the large section of the piston has a V-shaped profile whose concavity faces toward the small section, that is to say downwardly according to the representation shown in the drawings. This V-shaped profile is bounded on the outer side by the lip 48 which provides sealing against the wall of the casing and, on the inner side, by a slightly frustoconical lip 58 which provides sealing against the piston.

The ring 50 comprises, on the opposite side to the lips 48, 58, another frustoconical sealing lip 59 facing in the opposite direction, the diameter of which increases in the direction of the cover of the casing. This lip 59 provides protection for the sealing region between piston and casing, at the level of the lip 48, against any dropping of abrasive particles.

The circular ring 51 of the small section of the piston has a V-shaped cross section whose concavity faces toward the large section, that is to say upwardly according to FIG. 7. The outer branch of the V forms the sealing lip 49 between the piston and casing.

The outer wall of the piston 4, as can be seen from FIG. 6, comprises two recessed regions, such as 4*a*, extending below the seats of the valves 16 and allowing their reciprocating vertical movements.

The motor M can be assembled in the following way.

The sealing rings 50, 51, shown in FIG. 7, can be fitted onto the piston 4, using the bayonet fastening, prior to installing the valves.

One subassembly (FIG. 6) can be formed by engaging the spindle 206 of the elastic leaf 23 in the notches 22 of the pusher 18, while the spindle 20*a* is engaged in the housings 21 of the connecting rod 14. This subassembly can then be installed in the piston 4 by engaging the rod 31 of the pusher 18 in the guide well 32 and by engaging the pins 28 of the connecting rod 14 in the notches 24.

Keeping the leaf 23 in place, by snap-fastening the spindle 20*a* into the housings 21 of the connecting rod and the spindle 20*b* into the notches 22, facilitates handling of the subassembly (connecting rod 14—elastic leaf 23—pusher 18) during assembly.

Another subassembly is prepared from the valve holder 15, 39 into whose lower part the valves 17 are snap-fastened. The valve holder 15, 39 is then engaged in the piston 4 with a vertical descending movement by introducing the ribs 40 into the corresponding guide grooves of the piston.

The valves 16 with their upwardly directed stems are then presented below the crown 5. The stem 45 of each valve 16 is then passed through the opening of the corresponding seat for the purpose of snap-fastening the upper end of this stem into the housing 44 of the valve holder 15, 39.

The assembly consisting of the piston, the pusher, the connecting rod and the valve holder is complete. All that is now required is to engage the piston in the body 2 and then to fit the cover 3 onto the body 2 by screwing.

The operations of disassembling or replacing defective parts can be deduced from the explanations given above and are extremely simple and quick.

The operation of the motor is similar to that described in EP 1 151 196 and will be recalled only in brief with reference to FIG. 1, in which the piston 4 is on its upstroke. The liquid under pressure, generally water, arrives via the inlet 10. The valves 16 are closed whereas the valves 17 are open, allowing liquid to be delivered from the chamber 9 to the chamber 11 and the outlet 12.

At the end of the upstroke, the pusher 18 comes to bear against a limit stop connected to the cover 13, which results, under the effect of the spring leaf 23, in the connecting rod 14 being tilted toward the other lower stable position, with movement of the valve holder 15 toward the bottom 6*a* of the piston. The valves 17 close while the valves 16 open. The liquid under pressure passes into the closed chamber 9 and the movement of the piston is reversed.

At the end of the downstroke, the pusher 18, by way of its lower end, comes up against a limit stop G secured to the casing, which results in a new tilting movement of the connecting rod 14 toward the raised position and in a movement of the valve holder 15 which causes the valves 16 to close and the valves 17 to open. The movement of the piston 5 is reversed once more and the piston starts again on its upstroke.

Figure 8:
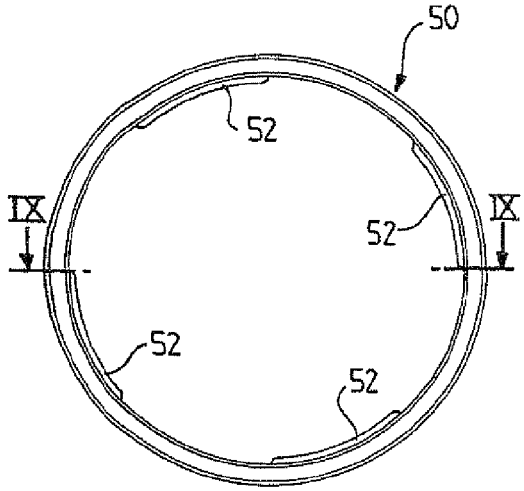
FIG. 8 is a bottom view of the seal for the large section of the piston.
Figure 11:
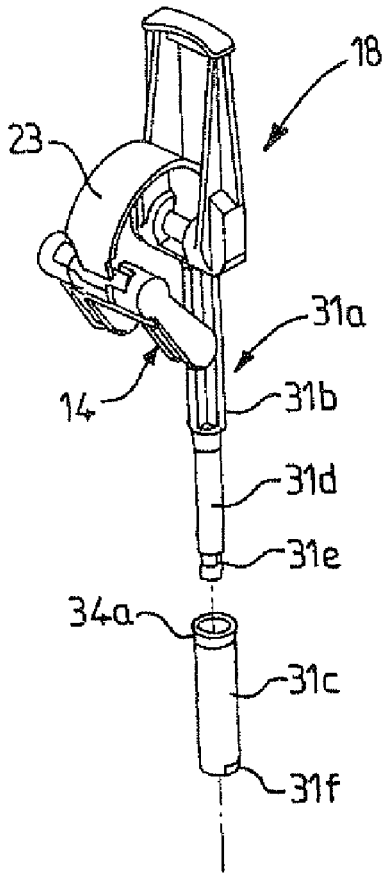
FIG. 11 is a perspective view of a variant embodiment of the two-part pusher in the course of assembly.

FIG. 11 illustrates a variant embodiment of the pusher 18, the rod 31*a* of which is produced in two parts 31*b*, 31*c* fitted together in a disassemblable manner. The upper part 31*b* is extended downwardly by a cylindrical shank 31*d* whose external diameter is smaller than that of the upper part of 31*b*. The lower part 31*c* has a cylindrical tubular shape to accommodate the shank 31*d*. A locking mechanism is provided between the two parts, in particular using a bayonet system 31*e*, 31*f* provided at the lower end of the parts. The pusher seal is advantageously constituted by a plastic ring 34*a* of V-shaped cross section having a double lip which is similar to the ring 51 but of smaller diameter. The concavity of the V is preferably directed upwardly. The ring 34*a* is assembled on the lower part 31*c* with a quarter-turn bayonet fastening system similar to that described in relation to FIGS. 7 to 9. This assembly makes it possible to easily change the ring 34*c* in the case of wear and allows a choice of plastic for the ring 34*a* that has good chemical inertia with respect to the liquids passing through the motor and the metering device.

Figure 12:
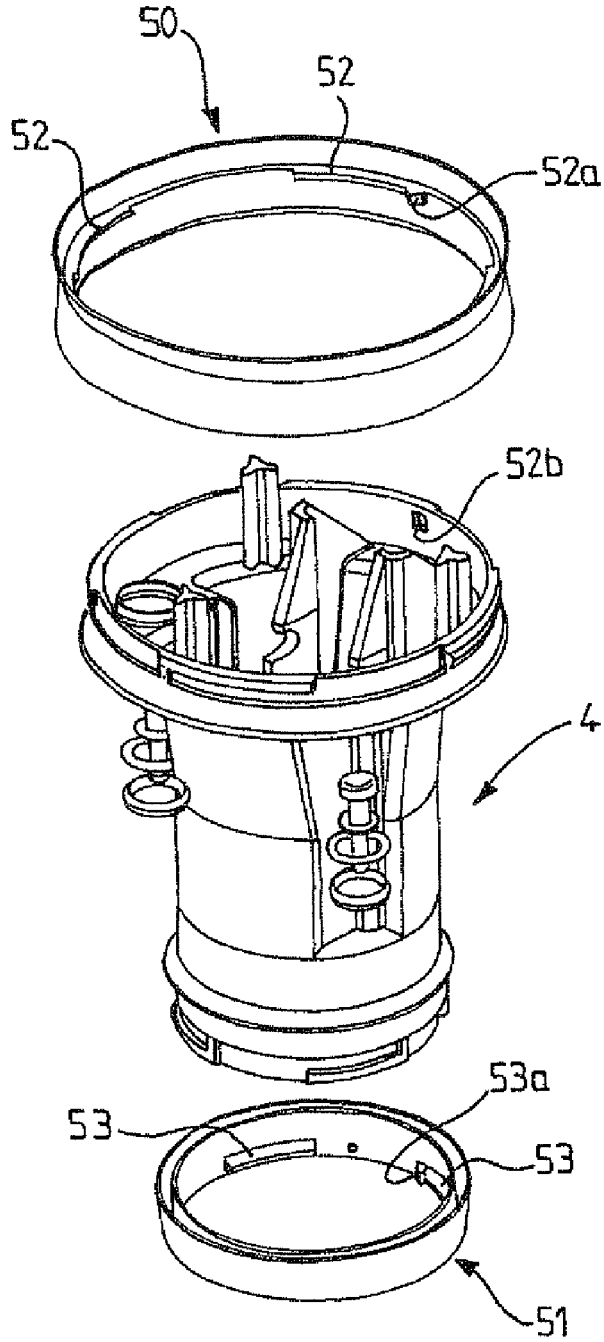
FIG. 12 is an exploded perspective view, similar to FIG. 7, of a variant embodiment of the piston and the seals.

FIG. 12 illustrates a variant embodiment of the disassemblable sealing rings 50, 51. According to this variant, a snap-fastening engagement of the rings 50, 51 on the piston 4 is provided at the end of rotation of the bayonet assembly. For this purpose, the ring 50 comprises an inward radial projection 52*a* provided at one end of a rib 52. A corresponding window 52*b* is provided in the lateral wall of the piston such that, at the end of rotation of the assembly, the projection 52*a* enters the window 52*b*. The ring 50 is thus locked rotationally, thereby preventing unwanted disassembly of the ring 50 during operation. To disassemble the ring 50, a tool is used to push the projection 52*a* from the inside, through the window 52*b*, to the outside so as to disengage it from the window.

A similar arrangement is provided for the lower ring 51 which comprises an inner radial projection 53*a*, at one end of a rib 53, to engage in a window (not shown in the drawing) of the piston 4.

The hydraulic motor, more generally the hydraulic machine, according to the invention can be made entirely of plastic, including the elastic means E formed by the leaf 23, and displays considerable resistance to chemical products in the absence of any metal parts.

The number of parts making up the machine is considerably reduced. Assembly and maintenance are simplified and made more straightforward.

The sealing ring 50 of the large section of the piston incorporates a protective lip 59. The disassemblable sealing rings 50, 51 make it possible to retain the opposed directions of sealing so that the additive product entering via the sleeve 13 can be injected into the outlet chamber 11.

The mechanism controlling the tilting movement of the connecting rod 14 and the change in position of the valve holder 15, 39 is a particularly simple one of the three-point type.

The invention claimed is:

1. A hydraulic machine, in particular a hydraulic motor, comprising:

a casing (1);

a piston (4) capable of sliding with a reciprocating movement in the casing, the piston separating two chambers (8, 9) of the casing;

hydraulic switching means (C) for supplying liquid to and for evacuating the chambers separated by the piston, these switching means being controlled by the movements of the piston and comprising at least one connecting rod (14) acting on a distribution member (15) which can adopt two stable positions; and triggering means comprising a pusher (18) capable, at the end of the stroke of the piston, of causing a sudden change in the position of the switching means, under the action of an elastic means (E), in order to reverse the stroke, characterized in that the elastic means (E) is secured, at each of its ends, to an articulation member (20*a*, 20*b*) respectively accommodated in a housing (21, 22) provided on the connecting rod and on another moving part (18) of the machine, each housing (21, 22) being open in a direction substantially opposite to the direction of the force exerted by the elastic means (E) in the housing, such that each articulation member (20*a*, 20*b*) can be removed from its open housing (21, 22) against the action of said force, thereby simplifying assembly and disassembly.

2. The machine as claimed in claim 1, characterized in that the articulation member secured to the elastic means (E) at each of its ends is constituted by a cylindrical spindle (20*a*, 20*b*), transverse to the direction of the force exerted by the elastic means (E), forming an articulation axis.

3. The machine as claimed in claim 1, characterized in that the elastic means (E) is constituted by a spring leaf (23) in the form of a curved arc.

4. The machine as claimed in claim 3, characterized in that the spring leaf (23) is made of plastic and the articulation spindles (20*a*, 20*b*) provided at each end are molded in one piece with this spring leaf.

5. The differential hydraulic machine as claimed in claim 1, with a piston having a region (5) of large cross section and a region (6) of smaller cross section, the switching means (C) comprising a valve holder (15) with at least a first valve (17) whose seat is provided on the small section (6) of the piston, and at least a second valve (16) whose seat is provided on the large section (5) of the piston, characterized in that each valve comprises a stem coupled to the valve holder, one of the valves (17) being situated on the same side as the connecting rod (14), with respect to the piston, and the other valve (16) being situated on the opposite side with a stem which passes through the seat to bring about coupling with the valve holder (15).

6. The hydraulic machine as claimed in claim 5, characterized in that the stem of the valve (16) situated on the opposite side to the connecting rod (14) is coupled by being snap-fastened to the valve holder (15), this snap-fastening being accessible from that side of the piston (4) where the connecting rod (14) is situated, such that disassembly of the valve and removal of the valve holder (15) are thereby facilitated.

7. The hydraulic machine as claimed in claim 1, characterized in that the connecting rod (14) is articulated at its end remote from the housing in a region (24) which is fixed relative to the piston (4).

8. The hydraulic machine as claimed in claim 7, characterized in that the connecting rod (14) is secured, at its end remote from the elastic means, to an articulation pin (28) oriented transversely to the connecting rod and accommodated in a notch (24) provided in a wall secured to the piston, this notch (24) being open in the direction opposite to the direction of the force exerted by the elastic means (E) on the connecting rod.

9. The hydraulic machine as claimed in claim 7, characterized in that two parallel component connecting rods (25, 26) are provided, interconnected by a crosspiece (27), each component connecting rod comprising, at its end close to the elastic means (E), a housing (21) which is open facing the other component connecting rod so as to accommodate one end of the articulation pin (20*a*) secured to the elastic means.

10. The hydraulic machine as claimed in claim 9, characterized in that each component connecting rod (25, 26) comprises two parallel branches between which is provided the pin (28) for articulation on the piston (4), this pin (28) being molded in one piece with the two branches of the connecting rod.

11. The hydraulic machine as claimed in claim 1, characterized in that the pusher (18) is secured in its upper part to a frame (35) having two walls (35*a*, 35*b*), which surround the elastic means, and at least one notch (22) which opens on the opposite side to the connecting rod (14), each notch (22) accommodating one of the ends of the articulation pin (20*b*) of the elastic means (E).

12. The hydraulic machine as claimed in claim 10, characterized in that the two walls (35*a*, 35*b*) surrounding the elastic means are extended on the opposite side to the pusher rod and are joined together by a crosspiece (36) in the upper part, this crosspiece constituting the upper limit stop of the pusher.

13. The hydraulic machine as claimed in claim 5, characterized in that the valve holder (15) has the form of a frame (39), vertical in the operating position, comprising on its two vertical sides outwardly projecting ribs (40) capable of cooperating with corresponding guide grooves provided in the piston.

14. The hydraulic machine as claimed in claim 13, characterized in that the lower horizontal side of the frame (39) comprises open housings (41) allowing a readily disassemblable coupling of valves (17) having their seat on the small section (6*a*) of the piston and situated on the same side as the connecting rod (14).

15. The hydraulic machine as claimed in claim 14, characterized in that the upper horizontal side of the frame is extended, at each end, beyond vertical pillars and comprises open housings (44) for accommodating by simple snap-fastening the stem of a valve (16), having its seat on the large section of the piston, on the opposite side to the connecting rod (14).

16. The hydraulic machine as claimed in claim 5, characterized in that the piston (4) is provided at its large section (5) and its small section (6*a*) with sealing lips (48, 49) oriented in opposite directions and facing one another.

17. The hydraulic machine as claimed in claim 16, characterized in that the sealing lips are provided on disassemblable circular rings (50, 51), and the piston (4) is molded in one piece.

18. The hydraulic machine as claimed in claim 17, characterized in that each sealing ring (50, 51) is fastened to the piston by a bayonet-type assembly comprising radial projections (52, 53) on the internal surface of the ring and corresponding peripheral grooves (54, 55) on the external surface of the piston, with grooves (56, 57) parallel to the geometric axis of the piston to allow each projection of the seal to come level with a corresponding peripheral groove of the piston.

19. The hydraulic machine as claimed in claim 17, characterized in that the sealing ring (50) provided at the large section of the piston has a V-shaped profile whose concavity faces toward the small section, and comprises on the opposite side a frustoconical sealing lip (59) whose diameter increases in the direction of the cover of the casing.

20. The hydraulic machine as claimed in claim 17, characterized in that the circular ring (51) of the small section of the piston has a V-shaped cross section whose concavity faces toward the large section.

* * * * *